United States Patent [19]

Marbacher

[11] 4,118,919

[45] Oct. 10, 1978

[54] YARN TAKE-UP AND SUPPLY MECHANISM FOR USE WITH TEXTILE MACHINES

[75] Inventor: Lothar Marbacher, Krefeld, Germany

[73] Assignee: Palitex Project Company GmbH, Krefeld, Germany

[21] Appl. No.: 842,894

[22] Filed: Oct. 17, 1977

[30] Foreign Application Priority Data

Oct. 16, 1976 [DE] Fed. Rep. of Germany ..... 2646873

[51] Int. Cl.[2] ..... D01H 15/00; D01H 1/10

[52] U.S. Cl. ..... 57/34 R; 57/58.7; 139/452; 242/47.12

[58] Field of Search ..... 57/34 R, 58.7, 58.83–58.86; 226/7, 97; 242/47–47.13; 139/452

[56] References Cited

U.S. PATENT DOCUMENTS

| | | | |
|---|---|---|---|
| 3,229,725 | 1/1966 | Saito | 139/452 X |
| 3,370,618 | 2/1968 | Svaty et al. | 139/452 X |
| 3,411,548 | 11/1968 | Pfarrwaller | 242/47.12 X |
| 3,604,472 | 9/1971 | Nydam | 139/452 |
| 3,648,939 | 3/1972 | Rosen | 242/47.01 |
| 3,672,590 | 6/1972 | Rosen | 242/47.12 |
| 3,687,384 | 8/1972 | Rosen | 242/47.12 |
| 3,731,478 | 5/1973 | Franzen | 57/34 R X |
| 3,975,893 | 8/1976 | Franzen | 57/34 R |
| 3,981,128 | 9/1976 | Munker | 57/34 R |
| 3,982,568 | 9/1976 | Riha et al. | 139/452 |
| 4,002,190 | 1/1977 | Sevcik et al. | 139/452 |
| 4,028,911 | 6/1977 | Fecker et al. | 242/47.12 X |

*Primary Examiner*—John Petrakes

*Attorney, Agent, or Firm*—Bell, Seltzer, Park & Gibson

[57] ABSTRACT

A yarn take-up and supply mechanism for use with textile machines processing yarn, such as during a threading-up operation of the machine, characterized by a construction for coiling a given length of yarn into a single-layer winding to produce a yarn storage and for releasing the stored yarn to the textile machine in a substantially tension-free condition, including the following. A selectively-rotatable elongate drum is operatively mounted at one end on a frame portion of the mechanism and defines an outwardly-extending overhanging free other end for winding of a given length of the yarn on the outside surface thereof. Selectively-operable clamping devices are mounted on and positioned generally at the free end of the drum for receiving a free end of the yarn and for clamping the free end of the yarn during winding of the yarn on the drum and for releasing the free end of the yarn after winding for supplying of the yarn to the textile machine from the surface of the drum by unwinding. A selectively-movable yarn guide device is mounted on the frame for slidably receiving the clamped yarn therethrough and for movement from the free end of the drum rearwardly along the drum for guiding the yarn onto the outside surface of the drum for winding thereof into a coiled single layer permitting subsequent unwinding in a substantially tension-free condition and for releasing the yarn and returning to its starting position after winding. Preferably, selectively-operable suction devices are operatively associated with the clamping devices for cooperating therewith when the clamping devices are open to draw the free end of yarn into the clamping devices for subsequent closing thereof to hold the free end of yarn therein. Also, preferably, selectively-operable compressed air devices are operatively associated with the clamping devices for cooperating therewith when the clamping devices are open for creating a positive compressed air stream to remove the free end of yarn from the clamping devices and for conveying the free end of yarn to a desired location in the textile machine.

33 Claims, 10 Drawing Figures

YARN TAKE-UP AND SUPPLY MECHANISM FOR USE WITH TEXTILE MACHINES

This invention relates to a yarn take-up and supply mechanism for use with textile machines processing yarn, such as during an automatic threading-up operation of a two-for-one twister or the like yarn processing machine, characterized by a construction for coiling a given length of yarn into a single-layer winding to produce a yarn storage and for releasing the stored yarn to the textile machine in a substantially tension-free condition.

BACKGROUND OF THE INVENTION

In textile machines which process yarn, it is often necessary to provide a mechanism for taking-up of a predetermined length of yarn and for supplying of this yarn to the textile machine for various purposes. This is particularly true in the case of two-for-one twister textile yarn processing machines utilizing pneumatic or other types of automatic threading mechanisms for threading-up the spindle assemblies thereof upon starting-up of the spindle assembly or following breakage of the yarn during yarn processing. Such two-for-one twister textile yarn processing machines with pneumatic threading mechanisms for threading-up the spindle assembly are disclosed in U.S. Pat. No. 3,731,478, issued May 8, 1973, and U.S. Pat. No. 3,975,873, issued Aug. 24, 1976, both of which are assigned to the assignee of the present invention.

As may be seen in both of these U.S. patents, there is provided a two-for-one twister or the like textile yarn processing machine having a plurality of spindle assemblies each including a driven rotating rotor mechanism, a stationary carrier mechanism for carrying a hollow supply package of yarn, and an elongate yarn passageway extending downwardly through the top of the carrier mechanism along the axis of the spindle assembly and radially outwardly through the rotor mechanism for receiving the yarn from the supply package therethrough and then upwardly along the outside of the carrier mechanism for forming a rotating balloon of yarn during yarn processing and which is subsequently taken-up by a take-up mechanism. There is also described in these U.S. patents selectively-operable pneumatic threading mechanisms for automatically threading yarn withdrawn from the supply package through the passageway of the spindle assembly by creating a suction through the yarn entry portion of the passageway and a positive air stream through the yarn exit portion of the passageway.

In order to accomplish suitable pneumatic threading-up, the yarn must be pulled from the supply package of yarn and supplied to the entry of the yarn passageway through the spindle assembly in a substantially tension-free condition so that the suction and positive air stream created through the yarn passageway in the spindle assembly can effectively thread the yarn therethrough. Often, problems have existed with respect to removing the yarn from the supply package and supplying it to the passageway in the spindle assembly for automatic pneumatic threading in a substantially tension-free condition. Accordingly, there is a need in these types of machines for a yarn take-up and supply mechanism which can take-up and store a given length of yarn and supply the stored yarn to the textile machine in a substantially tension-free condition.

Heretofore, yarn take-up and supply mechanisms, also called yarn regulating devices, have been typically used in weaving and knitting machines and were instrumental in insuring the slip-free positive supply of fixed lengths of yarn at high yarn running speeds to these machines. Such yarn storage devices are disclosed in U.S. Pat. No. 4,028,911, issued June 14, 1977; U.S. Pat. No. 3,687,384, issued Aug. 29, 1972; U.S. Pat. No. 3,672,590, issued June 27, 1972 and U.S. Pat. No. 3,648,939, issued Mar. 14, 1972.

In the yarn take-up and storage devices of these U.S. patents, the yarn runs onto one end of a take-up drum from a supply package and is passed directly onto the yarn processing machine, such as a circular knitting machine, from the other end of the drum. An axial displacement of the yarn windings on the drum takes place along the surface of the drum by a pinwheel gear member having teeth thereon which project into the circumference of the drum and move the windings of yarn forwardly on the drum as they are taken off from one end of the drum and are formed on the other end of the drum. These types of yarn take-up and storage mechanisms are continuously utilized during the supply of yarn from the supply packages to the yarn processing machines and remain in the feeding path or zone of yarn flow during the entire machine operation.

Accordingly, these previously known yarn take-up and storage devices cannot be utilized for intermittently taking-up and storing a given length of yarn and then supplying this store of yarn in a substantially tension-free condition to an associated textile machine, such as for use during a threading-up operation of the machine, and which would thereafter not be in the normal path of travel of the yarn through the textile machine during processing of the yarn therein.

OBJECTS AND SUMMARY OF THIS INVENTION

Accordingly, it is the object of this invention to overcome the above-described problems and to provide a yarn take-up and supply mechanism for use with textile machines processing yarn, such as during a threading-up operation of the machine, which is characterized by a construction for coiling a given length of yarn into a single-layer winding to produce a yarn storage and for releasing the stored yarn to the textile machine in a substantially tension-free condition.

It is a further more specific object of this invention to provide such a yarn take-up and supply mechanism in combination with a textile yarn processing machine, such as a two-for-one twister or the like, having a plurality of spindle assemblies each including a driven rotating rotor mechanism, a stationary carrier mechanism for carrying a hollow supply package of yarn, and an elongate yarn passageway passing downwardly through the top of the carrier mechanism along the axis of the spindle assembly and radially outwardly through the rotor mechanism for receiving the yarn from the supply package therethrough and then upwardly along the outside of the carrier mechanism for forming a rotating balloon of yarn during yarn processing and having selectively-operable pneumatic threading mechanisms for being operated to automatically thread yarn withdrawn from the supply package through the passageway during threading-up of the spindle assembly by creating a suction through the yarn entry portion of the passageway and a positive air stream through the yarn exit portion of the passageway, in which the yarn take-up and supply mechanism of this invention will coil a given length of yarn from the supply package into a single-layer winding to produce a yarn storage and will release the stored yarn to the textile yarn processing machine in a substantially tension-free condition for receipt by the threading mechanisms for threading-up of the spindle assemblies of the textile yarn processing machine.

In accordance with this invention, the above objects may be accomplished by providing such yarn take-up and supply mechanism which comprises broadly the following.

A frame means is provided to which a selectively-operable elongate drum means is operatively mounted at one end and defines an outwardly-extending overhanging free other end for winding of a given length of yarn on the outside surface thereof. Selectively-operable clamping means are mounted on and positioned generally at the free end of the drum means for receiving a free end of the yarn and for clamping the free end of the yarn during winding of the yarn on the drum means and for releasing the free end of the yarn after winding for supplying of the yarn to the textile machine from the surface of the drum means by unwinding. Selectively-movable yarn guide means are mounted on the frame for slidably receiving the clamped yarn therethrough and for movement from the free end of the drum means rearwardly along the drum means for guiding the yarn onto the outside surface of the drum means for winding thereof into a coiled single layer permitting subsequent unwinding in a substantially tension-free condition and for releasing the yarn and returning to its starting position after winding.

Preferably, a yarn holding member is provided for engaging and holding at least the last winding of yarn on the drum means during winding so that the yarn guide means may be returned to its starting position without unwinding of the yarn from the drum means and so that the yarn may be easily supplied to the machine by unwinding from the drum means from the free end rearwardly to the held winding.

There are preferably provided selectively-operable suction means operatively associated with the clamping means for cooperating therewith when the clamping means is open to draw the free end of the yarn into the clamping means for subsequent closing of the clamping means to hold the free end of yarn therein. Also, a selectively-operable compressed air means is preferably provided which is operatively associated with the clamping means for cooperating therewith when the clamping means is open for creating a positive compressed air stream to remove the free end of yarn from the clamping means and for conveying the free end of yarn to a desired location in the textile machine.

The mechanism also preferably includes drive means connected with the drum means for being selectively-operated to rotate the drum means a predetermined cycle for winding a given length of yarn thereon, and drive means connected with the yarn guide means and with the drum drive means for moving the guide means through a complete cycle of movement from the free end of the drum means, rearwardly along the drum means and back to its starting position during a cycle of driving rotation of the drum means.

When used with certain textile machines, such as a two-for-one twister having pneumatic threading mechanisms for threading of the yarn through the spindle assembly, there may be provided a trolley mechanism movably mounted along the textile yarn processing machine and extending along each of the plurality of spindle assemblies and movably carrying the yarn take-up and supply mechanism so that the yarn take-up and supply mechanism may be positioned in front of a respective spindle assembly when a threading operation thereof is desired for providing a take-up and supply operation.

Accordingly, this invention has provided a yarn take-up and supply mechanism which may be used with textile machines processing yarn, particularly two-for-one twister yarn processing machines having automatic pneumatic threading mechanisms for threading the yarn through the spindle assembly, which will coil a given length of yarn into a single-layer winding to produce a yarn storage and will release the stored yarn in a substantially tension-free condition for use in the textile machine and particularly for ease in pneumatic threading through the machine. The mechanism of this invention will take-up a desired given length of yarn which is necessary for pneumatic threading through the spindle assembly of the machine and eliminate any necessity for measuring of an amount of yarn to be pulled from a supply bobbin for automatic pneumatic threading.

BRIEF DESCRIPTION OF THE DRAWINGS

Some of the objects and advantages along with a broad description of this invention have been set forth above; other objects, advantages and a more detailed description of the construction of the mechanism of this invention will appear as the description proceeds, when taken in conjunction with the following drawings, in which.

DESCRIPTION OF PREFERRED EMBODIMENT

While the drawings and specific description to follow will be related to a two-for-one twister textile yarn processing machine, which is the preferred textile machine utilizing the improved yarn take-up and supply mechanism of this invention, it is to be understood that this yarn take-up and supply mechanism could be utilized with other textile machines for which a take-up and supply function of the yarn is desirable.

Figure 1:
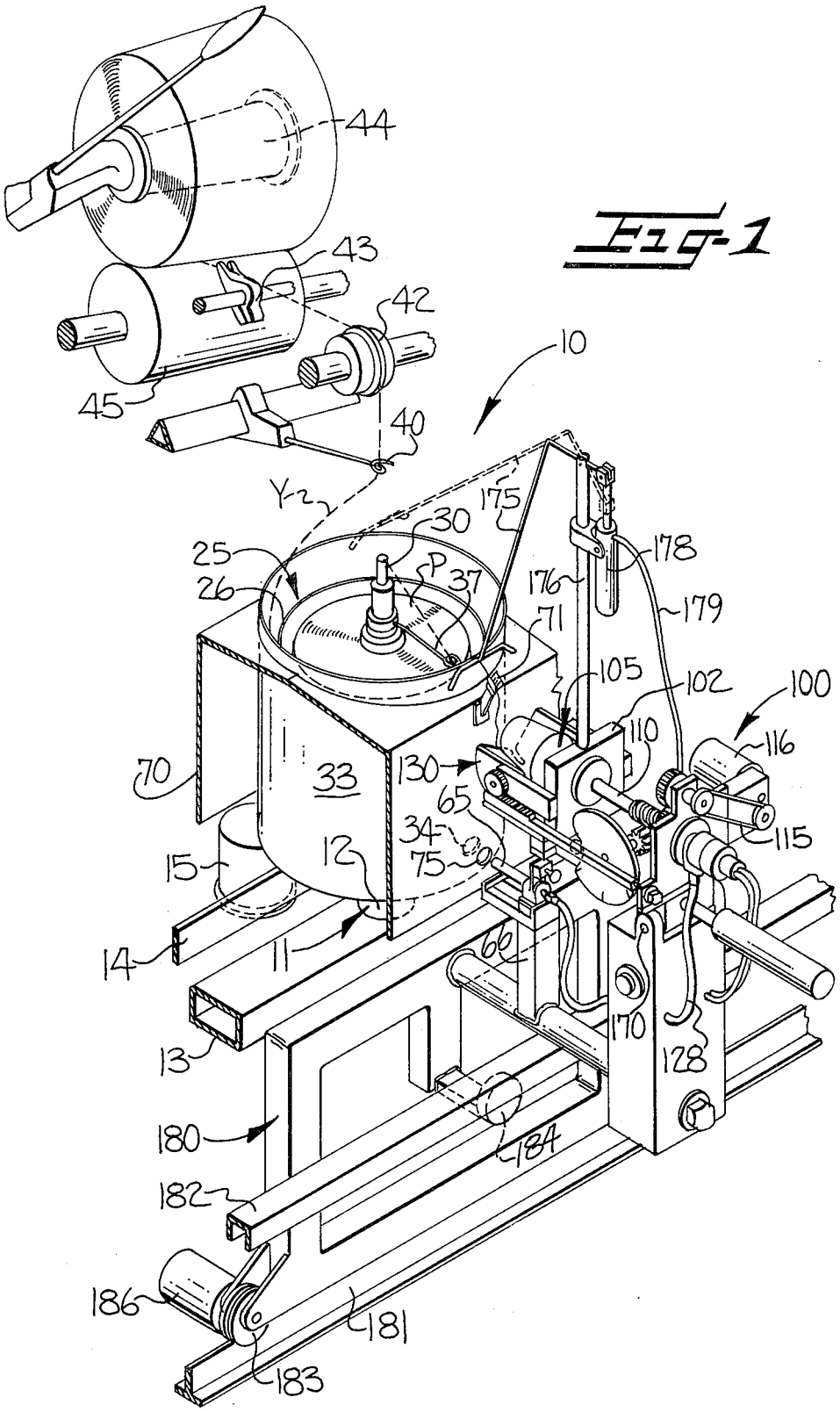
FIG. 1 is a somewhat schematic, perspective view, of one spindle assembly station of a two-for-one twister textile yarn processing machine utilizing the yarn take-up and supply mechanism of this invention.

Referring now to the drawings, there is illustrated in FIG. 1, a schematic perspective view of a single spindle assembly station, generally indicated at 10, of a two-for-one twister textile yarn processing machine. It is to be understood that a plurality of these spindle assembly stations 10 are provided in a two-for-one twister in side-by-side relationship in two rows along the outside of the machine. A full illustration and description of the entire two-for-one twister is not given herein and is not believed to be necessary for an understanding of the present invention, the operation and complete structure of such two-for-one twisters are well understood to those with ordinary skill in the art.

Figure 2:
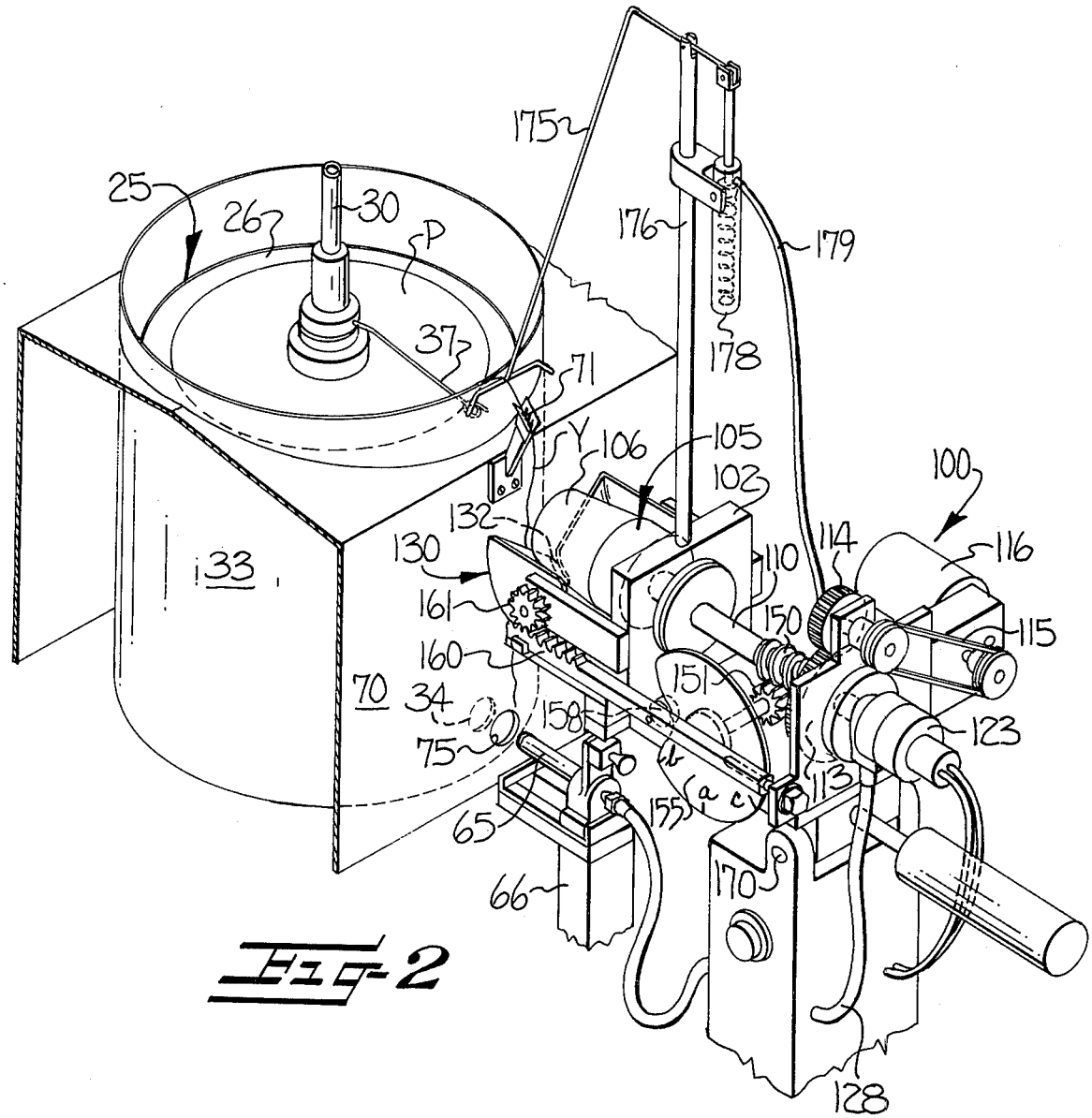
FIG. 2 is an enlarged perspective view of a portion of the apparatus shown in FIG. 1 for clarity of illustration of the mechanism of this invention.
Figure 3:
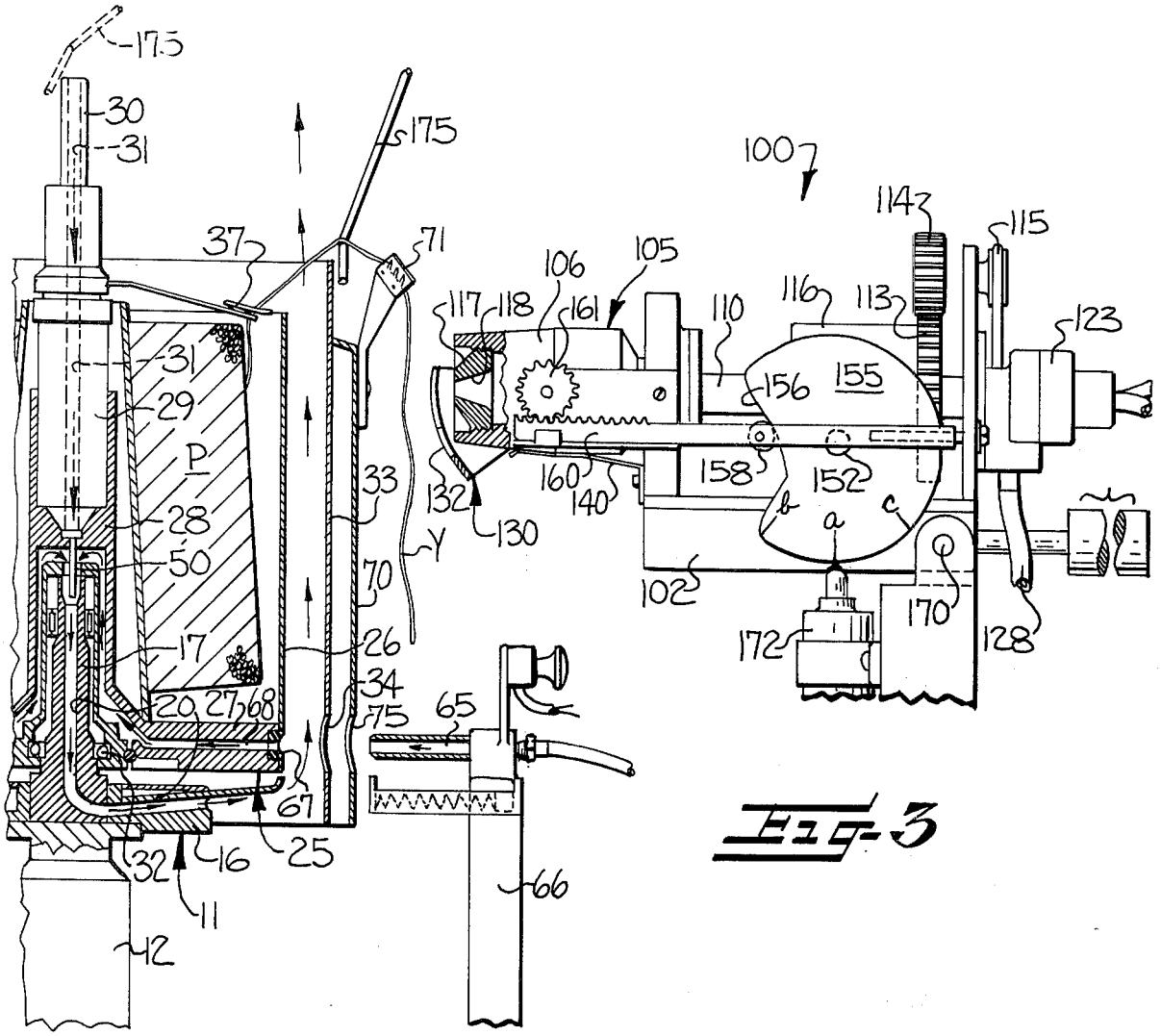
FIG. 3 is a partial elevational cross-sectional view taken through the apparatus illustrated in FIG. 2.

Each of the spindle assemblies 10 (see FIGS. 1–3 particularly) comprises a rotatably driven rotor mechanism, generally indicated at 11, which includes a whorl portion 12 suitably rotatably mounted on a portion of the twister frame 13 and rotated by a continuous, tangential drive belt 14 in a manner well understood by those with ordinary skill in the art. Tension rolls 15 are associated with each spindle assembly station 10 and are pivotally mounted for engaging and holding the drive belt 14 in tight driving engagement with the whorl portion 12 for normal rotation of the rotor mechanism 11 of the spindle assembly 10. The rotor mechanism 11 further includes a horizontally-extending yarn reserve disc device 16 secured to the whorl 12 for rotation therewith and a generally vertically-extending hollow axle device 17 which also rotates with the reserve disc 16. The reserve disc 16 and hollow axle device 17 define therewithin a generally L-shaped yarn passageway 20 extending generally vertically through the hollow axle device 17 and a portion of the yarn reserve disc 16 and generally horizontally and radially out of the yarn reserve disc 16.

The spindle assembly station 10 further includes a stationary carrier mechanism, generally indicated at 25, for supporting and carrying a hollow package P of yarn Y and which is rotatably mounted on the rotor mechanism 11 so that the rotor mechanism 11 may rotate relative thereto. The carrier mechanism 25 comprises a basket device 26 which surrounds the package P of yarn Y, a circular bottom portion 27 for supporting the hollow yarn supply package P and a hollow hub portion 28 extending into the hollow yarn supply package P for stabilizing the yarn supply package. The hollow hub portion 28 may include a hollow yarn package carrier member 29 in partial telescoping relationship therein which carries a hollow yarn entry tube 30 at the upper end thereof. As may be seen particularly in FIG. 3, the hollow axle device 17 of the rotor mechanism 11 extends into the hollow hub portion 28 of the carrier mechanism 25 and the carrier mechanism 25 is rotatably mounted on the rotor mechanism 11 by means of bearings 32, so that the rotor mechanism 11 may rotate relative to the stationary carrier mechanism 25 which is held stationary by any suitable means, such as magnetic means (not shown).

The carrier mechanism 25 including the carrier member 29, the yarn entry tube 30 and the hollow interior of the hub portion 28 define a generally vertically-extending yarn passageway 31 which is disposed in axial alignment with the yarn passageway 20 through the rotor mechanism 11 and joins with the yarn passageway 20 for providing a continuous elongate yarn passageway 31, 20 passing downwardly through the top of the carrier mechanism 25, along the axis of the spindle assembly 10 and radially outwardly through the rotor mechanism 11.

The spindle assembly station 10 further includes a stationary balloon limitor device 33 surrounding the basket device 26 of the carrier mechanism 25 and having an aperture 34 therein for purposes to be described below. There is further included a pigtail flyer mechanism 37 rotatably mounted on the carrier member 29 and a yarn guide eyelet 40 positioned above and in axial alignment with the yarn entry tube 30 and the yarn passageway 31 therethrough. There is also included a pre-take-up roll 42, a yarn traversing mechanism 43 and a yarn take-up or package roll device 44 upon which the yarn Y is wound after being processed by the spindle assembly station 10. The package roll device 44 is rotated by friction drive roll 45 in a well known manner.

With the above-described mechanisms, the yarn Y is withdrawn from the package P, passes through the pigtail flyer mechanism 37, through the yarn entry tube 30 and the yarn passageway 31. From the passageway 31, the yarn Y passes through the generally L-shaped yarn passageway 20 of the rotating rotor mechanism 11 and out of the reserve disc 16. The yarn Y then passes upwardly between the basket device 26 and the balloon limitor 33 to form a rotating balloon of yarn Y as the rotor mechanism 11 is rotated. The yarn Y then passes through yarn guide eyelet 40 which limits the upper end of the rotating balloon of yarn, over pre-take-up roll 42 and is traversed by traversing mechanism 43 onto the package roll device 44 to complete its travel through the respective spindle assembly station 10. As is well understood by those with ordinary skill in the art, a two-for-one twist is inserted in the yarn during the above-noted path of travel.

The spindle assembly station 10 further includes pneumatically-operated, yarn threading mechanisms for automatically threading yarn Y withdrawn from the supply package P through the yarn passageway 31, 20 during threading-up of the spindle assembly station 10. These automatic, pneumatic, threading mechanisms may be constructed generally in accordance with the above-mentioned U.S. Pat. Nos. 3,975,873 or 3,731,478 of the assignee of the present invention; however, the pneumatic threading-up mechanisms of assignee's U.S. Pat. No. 3,975,873 have been broadly illustrated and described herein.

As may be seen in the drawings, these pneumatic threading-up mechanisms include a selectively-operated, air injector nozzle, generally indicated at 50, which selectively receives air under pressure from a connector 65 leading from a suitable source of compressed air and which is pivotally mounted on an arm 66 for being moved into and out of engagement through aperture 25 in balloon limitor 33 with an aperture 67 in the bottom portion 27 of the carrier mechanism 25. The aperture 67 leads by way of an air passageway 68 through the carrier mechanism 25 to the injector nozzle 50 for creating a positive air stream through the yarn passageway 20 through the rotor mechanism 11 and creates a negative air flow or suction through the yarn passageway 31 of the carrier mechanism 25. By the above arrangement, when the connector 65 is selectively inserted into the aperture 67 in the stationary carrier mechanism 25 by movement through the aperture 34 in the balloon limitor 33, the above-described air streams will be created so that yarn Y pulled from the supply package P may be placed at the entry to the yarn passageway 31 through the yarn entry tube 30 and will be sucked into the yarn passageway 31 to be pneumatically threaded therethrough and out of the yarn passageway 20 for automatic threading-up of the spindle assembly 10 during start-up or in the event of yarn breakage during yarn processing.

The spindle assembly 10 may further include an outer frame portion 70 upon which is mounted a yarn grip member 71 at the upper end thereof which includes a pair of resilient plate members 72 and 73 forming a slot therebetween having grooves (see FIG. 3) therein for receipt of a broken end or an otherwise free end of yarn Y therein for holding the yarn Y and for easily releasing the yarn Y upon movement in an upward direction along the grooves therein. This frame portion 70 also includes an aperture 75 for movement therethrough of the connector 65.

In accordance with this invention, the above-described textile yarn processing machine is provided with a yarn take-up and supply mechanism, generally indicated at 100, for use with the textile yarn processing machine and for cooperation with the pneumatic threading mechanisms for coiling a given length of yarn Y from the supply package P into a single-layer winding to produce a yarn storage and for releasing the stored yarn to the textile yarn processing machine in a substantially tension-free condition for receipt by the threading mechanisms for threading-up of the spindle assembly 10 of the yarn processing machine.

The yarn take-up and supply mechanism 100 comprises frame means, collectively indicated at 102, of desired configuration. A selectively-rotatable elongate drum 105, as shown in the drawings, has one end operatively mounted and carried by the frame 102, an outwardly-extending overhanging free other end, an outside surface 106 of a cone-shaped configuration tapering toward the free end thereof for winding of a given length of yarn thereon, and a hollow interior 107 opening outwardly through the free end.

The drum 105 is mounted for selective rotation at the one end thereof in the frame 102 by being secured at the one end to one end of a selectively-rotatable hollow shaft 110 which is rotatably carried by bearings 111 in a frame member 102 at the one end thereof and by bearings 112 at generally the other end thereof. The shaft 110 is rotatably driven by a gear 113 keyed thereto which intermeshes with a gear 114. The gear 114 is driven by a suitable belt drive 115 from a selectively operable motor 116 to rotate the drum 105 a predetermined cycle or number of revolutions for winding a given length of yarn Y on the outside surface 106.

Figure 4:
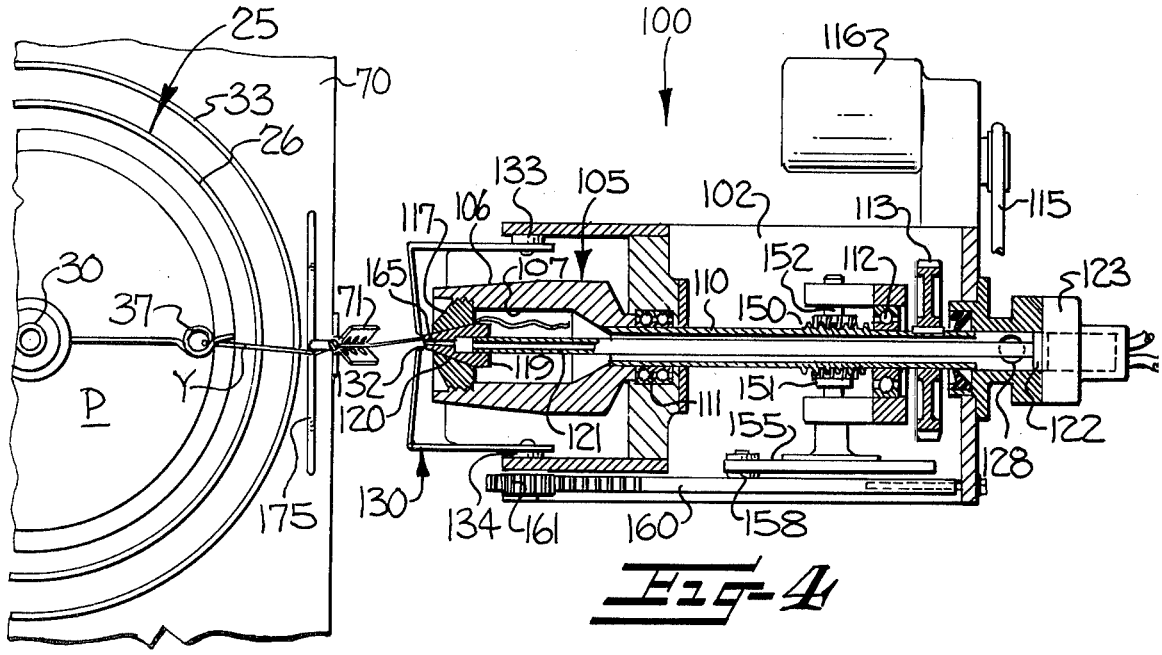
FIG. 4 is a partial cross-sectional view in plan of the apparatus illustrated in FIG. 3.

The take-up and supply mechanism 100 further includes selectively-operable clamping means including a stationary member 117 threadably positioned within the hollow interior 107 of the drum 105 at the free end thereof and includes an opening therethrough defining an inner outwardly-tapering conical-shaped stationary clamping surface 118. The clamping means further includes a selectively-operable linearly-reciprocating member 119 positioned within the hollow interior of the drum 105 and having an outer outwardly-tapering conical-shaped movable clamping surface 120 for cooperative movement into and out of clamping engagement with the stationary member 117 for receiving a free end of the yarn Y and for clamping the free end of the yarn Y (as shown in FIG. 4) during winding of the yarn Y on the drum 105 and for releasing the free end of the yarn Y after winding for supplying of the yarn to the textile machine from the surface of the drum 105 by unwinding.

The movable clamping member 119 is mounted for the above-described selectively-operable linearly-reciprocating movement into and out of clamping engagement with the stationary clamping member 117 by being secured at its rear end to the forward end of a hollow shaft 121. The hollow shaft 121 is positioned within the hollow drum driving shaft 110 and is connected at its rear end with a selectively-operable piston and cylinder mechanism 122, 123 which is suitably connected with a source of compressed air and with a source of suction, as indicated by the hose connections, for moving the piston 122 within the cylinder 123 for reciprocating movement of the hollow shaft 120 and the movable clamping member 119.

The yarn take-up and supply mechanism 100 further includes selectively-operable suction means operatively associated with the clamping means and including a source of suction operatively connected with the hollow interior 107 of the drum 105 for selectively applying suction thereto and for cooperating with the clamping members 117, 119 when out of clamping engagement with each other for drawing the free end of yarn Y into the hollow interior of the drum 105 between the clamping members, 117, 119 for subsequently closing the clamping members 117, 119 to hold the free end of yarn Y therebetween.

As may be seen in the drawings, this suction means includes any convenient source of suction leading through conduit 128 into the hollow interior of drum driving shaft 110 which communicates with the hollow interior 107 of the drum 105 for creating suction within the hollow interior 107 of the drum 105.

Figure 5:
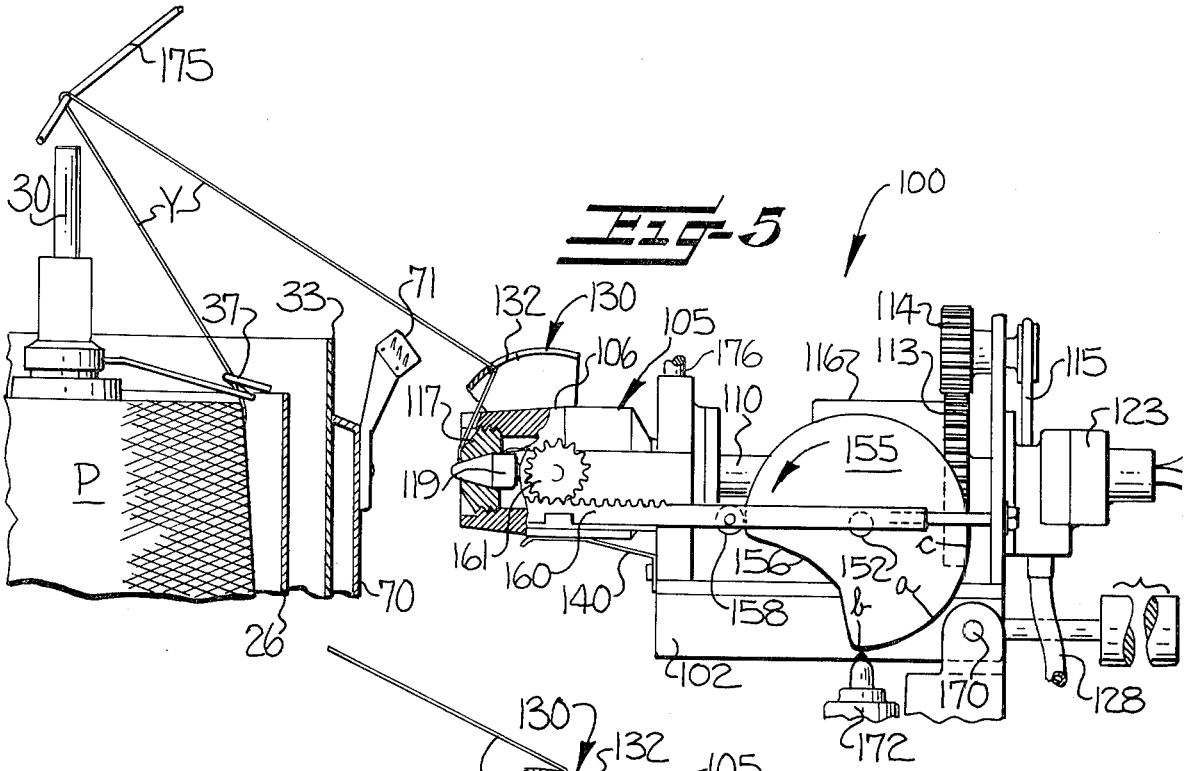
FIG. 5 is a side elevational view, partly in section, of the apparatus illustrated in FIG. 2 showing the mechanisms in the position at which the taking-up operation begins.
Figure 6:
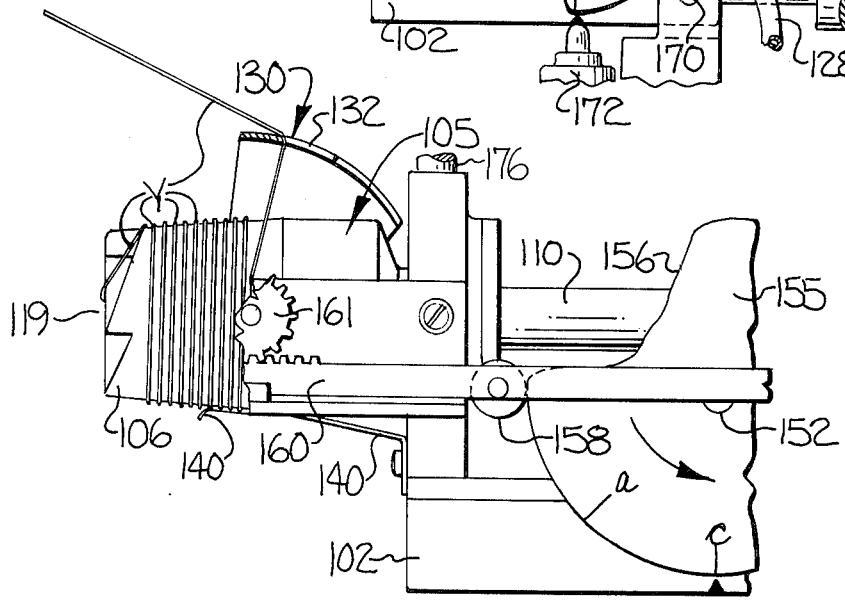
FIG. 6 is a view, somewhat similar to FIG. 5, showing the mechanisms in position after termination of the taking-up of a given length of yarn.
Figure 7:
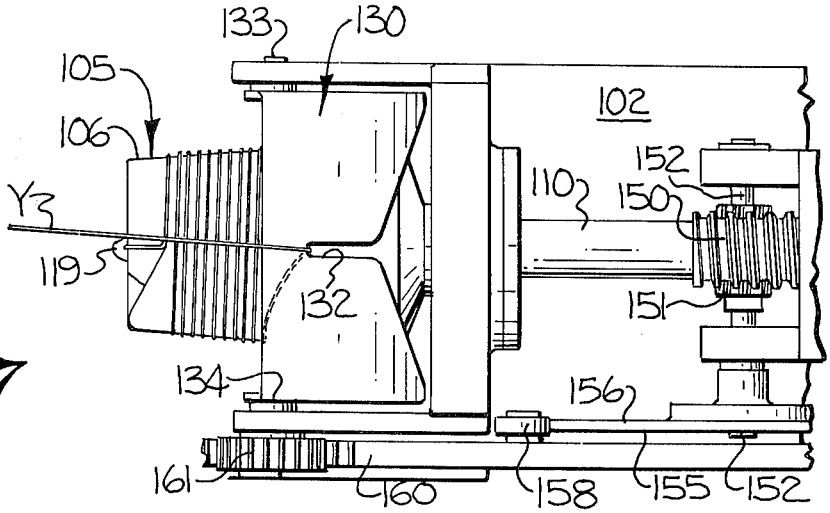
FIG. 7 is a top plan view of the mechanism with the devices thereof in the position illustrated in FIG. 6.

The yarn take-up and supply mechanism 100 further includes selectively-movable yarn guide means 130 of a generally U-shaped cross-sectional configuration (see FIG. 4) having a notch 132 extending downwardly from the upper surface thereof at a central location on the connecting leg thereof. Preferably, the entire upper surface of the connecting leg of the U-shaped yarn guide member 130 slopes downwardly into the notch 132. The free ends of guide member 130 are pivotally mounted at 133, 134 on frame members 102 for arcuate movement from a position below the yarn Y extending outwardly from the clamping members 117, 119 (FIGS. 3 and 4), upwardly while slidably engaging and carrying the yarn Y (FIG. 5) rearwardly along the outside surface 106 of drum 105 for guiding the yarn onto the outside surface 106 of the drum 105 for winding thereof into a coiled single layer (FIGS. 6 and 7), and returning to the starting position while releasing the yarn from the notch 132 (FIG. 8).

A resilient yarn holding member 140, preferably in the form of a leaf spring having one end thereof secured to a frame member 102 and the other end thereof biased against a rearward portion of the outside surface 106 of the drum 105, abuts against the outside surface 106 of the drum 105 at the rear thereof for engaging and holding at least the last winding of yarn Y on the drum 105 during winding (see FIG. 6) so that the yarn guide 130 may be returned to its starting position without unwinding of the yarn Y from the drum 105 and so that the yarn Y may be easily supplied to the textile machine by unwinding from the outside surface 106 of the drum 105 from the free end of the yarn Y being held by the clamping members 117, 119 rearwardly to the held winding on the surface 106 of the drum 105.

The drive means for moving the yarn guide 130 through a complete cycle of movement from the free end of the drum 105, rearwardly along the outside surface 106 of the drum 105 and back to its starting position during a cycle of driving rotation of the drum 105 comprises firstly a worm gear 150 secured on the drum driving shaft 110 for rotation therewith. A worm wheel 151 is in driven engagement with the worm gear 150 for rotation thereby. The worm wheel is connected with a shaft 152 which carries a rotatable cam 155 on the outer end thereof having a camming surface 156 of a predetermined profile for rotation by the worm gears 150, 151 one complete revolution during a driving cycle of the drum 105. A cam follower 158 is positioned in engagement with the camming surface 156 of the cam 155 and is carried by a rack gear 160 for linear reciprocating movement thereby. The rack gear member 160 engages a pinion gear 161 which is connected to one of the pivotal mountings 133 of the yarn guide member 130 for effecting the above-described arcuate movement of the yarn guide member 130 in response to the reciprocating movement of the rack gear member 160.

Figure 8:
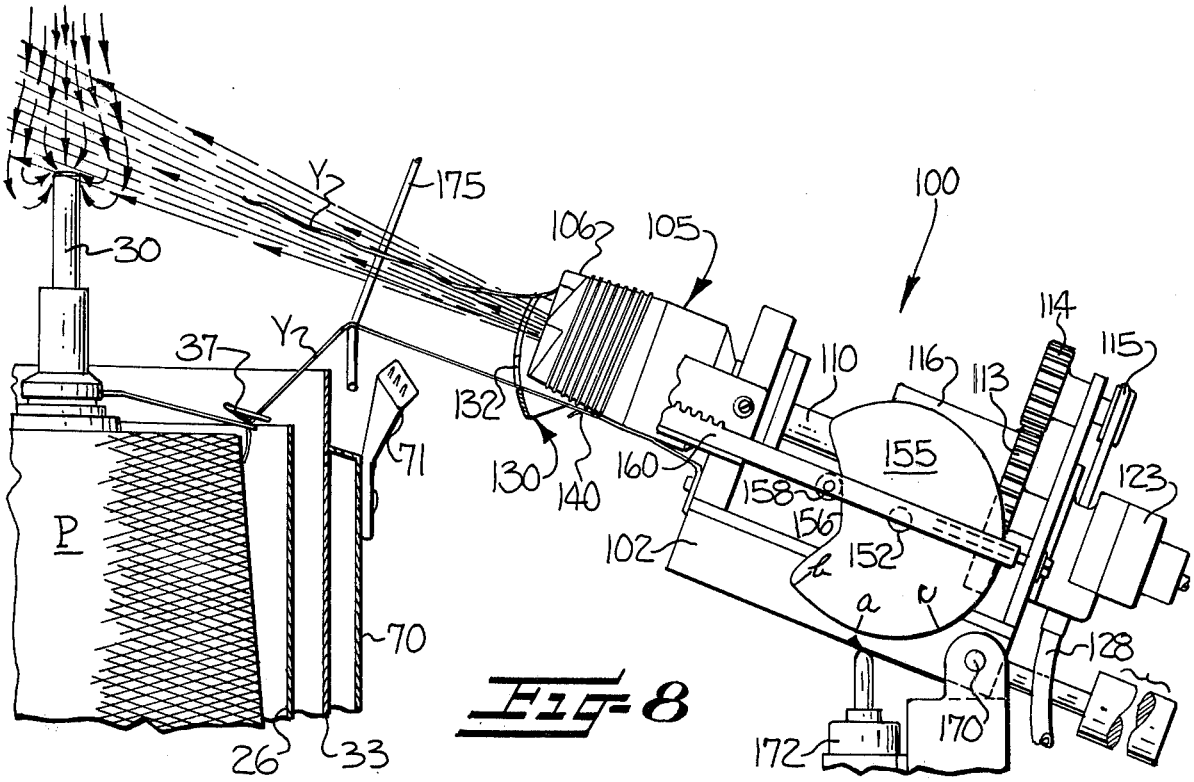
FIG. 8 is a diagrammatic side elevational view of the apparatus, shown in FIG. 2, with the devices thereof in the position at the start of the transfer of the taken-up supply of yarn to the automatic threading mechanisms of the spindle assembly of the two-for-one twister.
Figure 9:
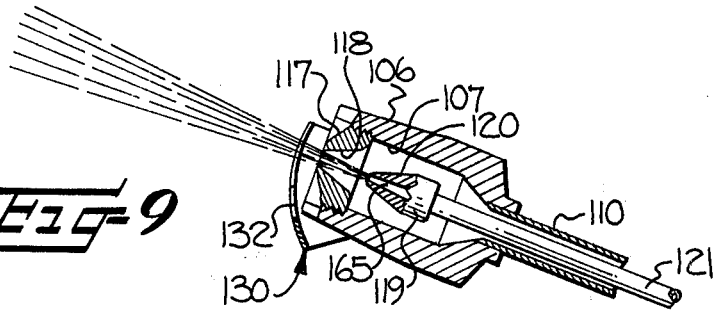
FIG. 9 is a sectional view through a portion of the mechanism illustrated in FIG. 8.
Figure 10:
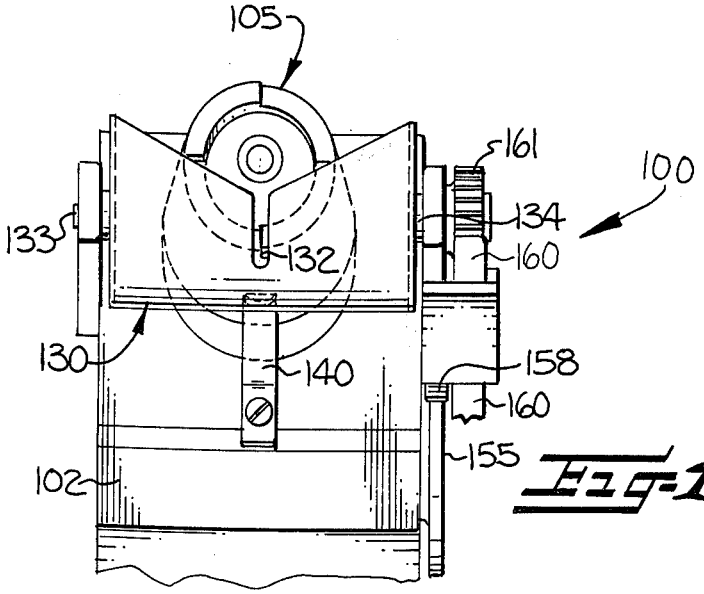
FIG. 10 is a front elevational view of the mechanism of this invention.

The yarn take-up and supply mechanism 100 further includes selectively-operable compressed air means including a passageway 165 extending through the movable clamping member 119 and terminating in a nozzle aperture at the forward end thereof and a source of compressed air operatively-connected with the passageway 165 through the hollow interior of shaft 121 for selectively creating a positive compressed air stream through the clamping member 119 and out of the nozzle aperture at the forward end thereof to remove the free end of yarn Y from between the clamping members 117, 119 and out of the hollow interior 107 of the drum 105 when the clamping members 117, 119 are out of clamping engagement with each other and for conveying the free end of yarn to a desired location in the textile machine and, preferably, as shown in FIG. 8, to the entranceway to the yarn passageway 31 through the yarn entry tube 30 so that the suction created therethrough by the above-described pneumatic threading mechanisms of the spindle assembly 10 may suck the free end of yarn Y therein and unwind the yarn Y from the outside surface 106 of the drum 105 for automatic threading of the yarn Y through the spindle assembly 10 of the textile machine.

In a preferred form of yarn take-up and supply mechanism 100, the frame 102 thereof is pivotally mounted at 170 on an upstanding frame portion 180 thereof for selective pivotal movement between a first position (FIG. 3) in which the clamping members 117, 119 and the free end of the drum 105 are pointing generally at a location below the yarn grip device 71 for receiving the free end of yarn Y into the hollow interior 107 of the drum 105 between the clamping members 117, 119 for clamping thereof and a second position (FIG. 8) in which the clamping members 117, 119 and the free end of the drum are pointing at a location above the entrance to the passageway 31 through the yarn entry tube 30 for conveying the free end of yarn Y by the compressed air means to a location at the entrance to the passageway 31, 20 through the spindle assembly 10. There may be provided means, such as a pneumatic piston and cylinder mechanism 172 for automatically pivoting the yarn take-up and supply mechanism from the first position to the second position and allowing it to return under the force of gravity or otherwise.

Also, the yarn take-up and supply mechanism of this invention may include a yarn finger 175 of suitable configuration and being pivotally mounted on an upstanding rod 176 from the frame 102 of the take-up and sypply mechanism 100. This yarn finger 175 is adapted for movement between a position (FIG. 3) in which the yarn finger is positioned under the free end of yarn Y being held by the grip 71 to a position above and in axial alignment with the yarn entry tube 30 of the spindle assembly 10 so as to remove the yarn Y from the grip 71 and position it in a better angle for winding thereof onto the outside surface 106 of the drum 105. The yarn finger 175 may then be returned to its initial position. For automating this movement of the yarn finger 175, there may be provided a suitable pneumatic piston and cylinder mechanism 178 suitably connected by a conduit 179 to a source of compressed air and/or suction for reciprocating movement of the piston thereof for reciprocating movement of the yarn finger 175 between the positions illustrated.

Additionally, when the yarn take-up and supply mechanism is utilized with a two-for-one twister textile yarn processing machine, such as illustrated in the drawings herein, it is preferable to provide a trolley mechanism 180 which is suitably mounted on rails 181, 182 by wheels or rollers 183, 184 for movement along each side of the yarn processing machine and along each of the spindle assembly stations 10 so that the yarn take-up and supply mechanism 100 may be positioned in front of a respective spindle assembly 10 when a threading-up operation thereof is desired. As illustrated in the drawings herein, the connector 65 of the spindle assembly threading mechanisms may also be carried by the trolley mechanism 180 for desired positioning at a specific spindle assembly location when the threading-up operation is desired. The trolley may be driven by a drive motor 186 for automatic positioning.

The yarn take-up and supply mechanism of this invention may include a suitable control circuit or other type of control mechanism (not shown) for effecting automatic operation of the above-described yarn take-up and supply operations of the mechanism 100 of this invention; however, such a control mechanism does not form a specific part of this invention and will not be described herein.

As may be seen from the above description, a cycle of operation of the mechanisms of this invention is generally as follows.

When a take-up package of yarn has been doffed from a particular spindle assembly 10 of the textile yarn processing machine following yarn processing thereof or when a yarn Y being processed has broken and a threading-up operation through the spindle assembly 10 by the pneumatic threading mechanisms is desired, the free end of yarn Y is pulled from the supply package P and inserted into yarn grip 71. The trolley mechanism 180 carrying the yarn take-up and supply mechanism 100 of this invention, as well as the pneumatic threading connector device 65, will then be suitably positioned in front of the particular spindle assembly 10. The connector mechanism 65 is inserted into the aperture 67 to create a threading-up air stream through the yarn passageway 30, 20 of the spindle assembly 10.

When this occurs, the yarn take-up and supply mechanism 100 of this invention is operated. The movable clamping member 119 is retracted by the piston and cylinder mechanism 122, 123 to a position out of engagement with the stationary clamping member 117 and the selectively-operable suction means is actuated to cause a suction within the hollow interior 17 of the drum 105 to draw the free end of yarn Y hanging down from the yarn grip 71 therein. The clamping member 119 is then moved into clamping engagement with clamping member 117 to hold the free end of yarn Y therebetween and the suction means may be deactuated. The yarn finger is then moved to its upper position removing the yarn Y from the grip 71 and providing a winding angle to the yarn Y.

The drum 105 then begins a cycle of rotation by the motor 116 being actuated to rotate the drum a predetermined number of revolutions for winding a given length of yarn Y on the outside surface 106 of the drum. As this occurs, the cam 155 is rotated through one complete cycle of revolution moving the yarn guide member 130 through its above-described path of travel for guiding the yarn into a single-layer winding on the outside surface of the drum 105. As may be seen by reference to FIGS. 3, 5, 6 and 8, when the indexing lines *a, b, c* on the cam 155 are opposite the pointer 185 on the frame member 102, the guide member 130 has moved through its various above-described positions.

Following take-up of the yarn Y by the mechanism 100, the yarn guide member 130 has moved back to its starting position and a given length of yarn Y is contained on the outside surface 106 of the drum 105 and the last few windings thereof are being held by the member 140. Also, the yarn finger 175 has been moved back to its starting position. The clamping members 117, 119 are then disengaged and the yarn take-up and supply mechanism 100 is pivoted to its second position (FIG. 8). The selectively-operable compressed air means is then actuated to cause an air flow through the passageway 165 and out of the nozzle in the clamping member 119 to direct the free end of yarn Y to a position above the yarn entry tube 30 for being sucked therein (FIG. 8) by the suction present and indicated by the arrows. The yarn will then unwind from the outside surface 106 of the drum 105 in a substantially tension-free condition for pneumatic threading through the spindle assembly 10.

In the drawings and specification there has been set forth a preferred embodiment of the invention and, although specific terms are employed, they are used in a generic and description sense only and not for purposes of limitation.

What is claimed is:

1. A yarn take-up and supply mechanism for selected intermittent use with textile machines processing yarn, such as during a threading-up operation of the machine, characterized by a construction for receiving a free end of yarn, coiling a given length of the yarn into a single-layer winding to produce a yarn storage and completely releasing the free end and stored yarn to the textile machine in a substantially tension-free condition for processing by the textile machine without passing through said mechanism during processing, said mechanism comprising:

frame means;

selectively-rotatable elongate drum means operatively mounted at one end on said frame and defining an outwardly-extending overhanging free other end for winding of a given length of the yarn on the outside surface thereof;

selectively-operable clamping means mounted on and positioned generally at the free end of said drum means for receiving a free end of the yarn and for clamping the free end of the yarn during winding of the yarn on said drum means and for releasing the free end of the yarn after winding to supply the free end and the stored yarn to the textile machine from the surface of said drum means by unwinding; and selectively-movable yarn guide means mounted on said frame for slidably receiving the clamped yarn therethrough, for movement from the free end of said drum means rearwardly along said drum means while guiding the yarn onto the outside surface of said drum means so that said drum means winds the yarn into a coiled single layer permitting subsequent unwiding in a substantially tension-free condition, and for releasing the yarn and returning to its starting position after winding.

2. A yarn take-up and supply mechanism, as set forth in claim 1, in which said mechanism further includes a yarn holding member for engaging and holding at least the last winding of yarn on said drum means during winding so that said yarn guide means may be returned to its starting position without unwinding of the yarn from said drum means and so that the yarn may be easily supplied to the machine by unwinding from said drum means from the free end rearwardly to the held winding.

3. A yarn take-up and supply mechanism, as set forth in claim 2, in which said yarn holding means comprises a leaf spring having one end thereof secured to said frame means and the other end thereof biased against a rearward portion of the outside surface of said drum means.

4. A yarn take-up and supply mechanism, as set forth in claim 1, in which said elongate drum means comprises a cone-shaped configuration tapering toward the free end of said drum means for ease in unwinding of the yarn for substantially tension-free supplying of the yarn to the textile machine.

5. A yarn take-up and supply mechanism, as set forth in claim 1, in which said mechanism further includes selectively-operable suction means operatively associated with said clamping means for cooperating therewith when said clamping means is open to draw the free end of yarn into said clamping means for subsequent closing of said clamping means to hold the free end of yarn therein.

6. A yarn take-up and supply mechanism, as set forth in claim 1, in which said mechanism further includes selectively-operable compressed air means operatively associated with said clamping means for cooperating therewith when said clamping means is open for creating a positive compressed air stream to remove the free end of yarn from said clamping means and for conveying the free end of yarn to a desired location in the textile machine.

7. A yarn take-up and supply mechanism, as set forth in claim 1, in which said drum means includes a hollow interior opening outwardly thereof through the free end, said clamping means comprises a stationary member positioned within the hollow interior of said drum means at the open free end thereof and having an opening therethrough defining an inner stationary clamping surface, and a selectively-operable linearly-reciprocating member position within the hollow interior of said drum means and having an outer movable clamping surface for cooperative movement into and out of clamping engagement with said stationary member, said mechanism further includes selectively-operable suction means operatively associated with said clamping means and including a source of suction operatively connected with the hollow interior of said drum means for selectively applying suction to said drum means for cooperating with said clamping members when out of clamping engagement for drawing the free end of yarn into the hollow interior of said drum means between said clamping members for subsequent closing of said clamping members to hold the free end of yarn therebetween, and said mechanism further includes selectively-operable compressed air means including a passageway extending through said movable clamping member and terminating in a nozzle aperture at the forward end thereof and a source of compressed air operatively connected with said passageway through said movable clamping member for creating a positive compressed air stream to remove the free end of yarn from between said clamping members and out of the hollow interior of said drum means when said clamping members are out of clamping engagement with each other and for conveying the free end of yarn to a desired location in the textile machine.

8. A yarn take-up and supply mechanism, as set forth in claim 7, in which said inner and outer clamping surfaces on said respective stationary and movable clamping members comprise cooperating outwardly-tapering conical-shaped surfaces.

9. A yarn take-up and supply mechanism, as set forth in claim 7, in which said mechanism further includes a selectively-rotatable shaft mounted on said frame means and connected at one end to the one end of said drum means for carrying and rotating said drum means and defining a hollow interior therethrough opening into the interior of said drum means and connected at the other end to said source of suction, and a selectively-reciprocable shaft positioned within the hollow interior of said selectively-rotatable shaft and connected at one end thereof to said movable clamping member for carrying and reciprocating said movable clamping member and defining a hollow interior therethrough opening into said passageway and nozzle aperture in said movable clamping member and connected at the other end thereof to said compressed air source.

10. A yarn take-up and supply mechanism, as set forth in claim 1, in which said mechanism further includes drive means connected with said drum means for being selectively operated to rotate said drum means a predetermined cycle for winding a given length of yarn thereon, and drive means connected with said yarn guide means and with said drum drive means for moving said guide means through a complete cycle of movement from the free end of said drum means, rearwardly along said drum means and back to its starting position during a cycle of driving rotation of said drum means.

11. A yarn take-up and supply mechanism, as set forth in claim 10, in which said yarn guide means comprises a generally U-shaped cross-sectional configured guide member having a notch extending downwardly from the upper surface thereof at a central location on the connecting leg thereof, and means pivotally mounting said guide member at each of the free ends thereof on said frame means for arcuate movement from a position below the yarn extending outwardly from said clamping means at the free end of said drum means, upwardly while engaging and carrying the yarn, rearwardly along said drum means, and returning to the starting position while releasing the yarn from said notch.

12. A yarn take-up and supply mechanism, as set forth in claim 11, in which said yarn guide drive means includes rotatable cam means having a camming surface of a predetermined profile thereon and connected to said drum drive means for rotation thereof one complete revolution during a driving cycle of said drum means, a cam follower positioned in engagement with said camming surface for linear reciprocating movement thereby, rack gear means connected to said cam follower for reciprocating linear movement thereby, and pinion gear means engaging said rack gear means and connected to said means pivotally mounting said yarn guide member for effecting the arcuate movement of said yarn guide member in response to reciprocating movement of said rack gear member.

13. A yarn take-up and supply mechanism, as set forth in claim 12, in which said drum drive means comprises selectively-operable motor means, gear means operatively connected to said motor means for being driven thereby, and shaft means rotatably mounted on said frame and having one end connected to said gear means for being rotated thereby and the other end connected to the other end of said drum means for carrying and rotating said drum means, and said mechanism further including worm gear means on said drum drive shaft means for rotation therewith, and worm wheel means in driven engagement with said worm gear means for rotation thereby and operatively connected with said yarn guide drive cam means for rotation thereof.

14. A yarn take-up and supply mechanism for use with textile machines processing yarn, such as during a threading-up operation of the machine, characterized by a construction for coiling a given length of yarn into a single-layer winding to produce a yarn storage and for releasing the stored yarn to the textile machine in a substantially tension-free condition, said mechanism comprising:

frame means;

selectively-rotatable elongate drum means having one end operatively mounted on said frame, an outwardly-extending overhanging free other end, an outside surface of a cone-shaped configuration tapering toward the free end for winding of a given length of yarn thereon, and a hollow interior opening outwardly through the free end;

selectively-operable clamping means including a stationary member positioned within the hollow interior of said drum means at the open free end thereof and having an opening therethrough defining an inner outwardly-tapering conical-shaped stationary clamping surface, and a selectively-operable linearly-reciprocating member positioned within the hollow interior of said drum means and having an outer outwardly-tapering conical-shaped movable clamping surface for cooperative movement into and out of clamping engagement with said stationary member for receiving a free end of the yarn and for clamping the free end of the yarn during winding of the yarn on said drum means and for releasing the free end of the yarn after winding for supplying of the yarn to the textile machine from the surface of said drum by unwinding;

selectively-operable suction means operatively associated with said clamping means and including a source of suction operatively connected with the hollow interior of said drum means for selectively applying suction thereto for cooperating with said clamping members when out of clamping engagement for drawing the free end of yarn into the hollow interior of said drum means between said clamping members for subsequent closing of said clamping members to hold the free end of yarn therebetween;

selectively-movable yarn guide means of a generally U-shaped cross-sectional configuration having a notch extending downwardly from the upper surface thereof at a central location on the connecting leg thereof and being pivotally mounted at each of the free ends thereof on said frame means for arcuate movement from a position below the yarn extending outwardly from said clamping means at the free end of said drum means, upwardly while slidably engaging and carrying the yarn, rearwardly along said drum means for guiding the yarn onto the outside surface of said drum means for winding thereof into a coiled single layer, and returning to the starting position while releasing the yarn from said notch;

a resilient yarn holding member abutting against the outer surface of said drum means at the rear thereof for engaging and holding at least the last winding of yarn on said drum means during winding so that said yarn guide means may be returned to its starting position without unwinding of the yarn from said drum means and so that the yarn may be easily supplied to the machine by unwinding from said drum means from the free end rearwardly to the held winding; and selectively-operable compressed air means including a passageway extending through said movable clamping member and terminating in a nozzle aperture at the forward end thereof and a source of compressed air operatively connected with said passageway through said movable clamping member for creating a positive compressed air stream to remove the free end of yarn from between said clamping members and out of the hollow interior of said drum means when said clamping members are out of clamping engagement with each other and for conveying the free end of yarn to a desirable location in the textile machine.

15. A yarn take-up and supply mechanism, as set forth in claim 14, in which said mechanism further includes a selectively-rotatable shaft mounted on said frame means and connected at one end to the one end of said drum means for carrying and rotating said drum means and defining a hollow interior therethrough opening into the interior of said drum means and connected at the other end to said source of suction, and a selectively-reciprocable shaft positioned within the hollow interior of said selectively-rotatable shaft and connected at one end thereof to said movable clamping member for carrying and reciprocating said movable clamping member and defining a hollow interior therethrough opening into said passageway and nozzle aperture in said movable clamping member and connected at the other end thereof to said compressed air source.

16. A yarn take-up and supply mechanism, as set forth in claim 15, in which said mechanism further includes drive means for being selectively operated to rotate said drum means a predetermined cycle for winding a given length of yarn thereon and comprising selectively-operable motor means and gear means operatively connected to said motor means for being driven thereby and operatively connected to said selectively-rotatable drum mounting shaft for rotating said shaft, and drive means for moving said guide means through a complete cycle of movement from the free end of said drum means, rearwardly along said drum means and back to its starting position during a cycle of driving rotation of said drum means and comprising worm gear means on said drum drive shaft for rotation therewith, worm wheel means in driven engagement with said worm gear means for rotation thereby, rotatable cam means having a camming surface of a predetermined profile thereon and operatively connected to said worm wheel means for rotation thereof one complete revolution during a driving cycle of said drum means, a cam follower positioned in engagement with said camming surface for linear reciprocating movement thereby, rack gear means connected to said cam follower for reciprocating linear movement thereby, and pinion gear means engaging said rack gear means and connected to said yarn guide member for effecting the arcuate movement of said yarn guide member in response to the reciprocating movement of said rack gear member.

17. In a textile yarn processing machine, such as a two-for-one twister or the like, having a plurality of spindle assemblies each including a driven rotating rotor mechanism, a stationary carrier mechanism for carrying a hollow supply package of yarn, and an elongate yarn passageway passing downwardly through the top of said carrier mechanism along the axis of said spindle assembly and radially outwardly through said rotor mechanism for receiving the yarn from the supply package therethrough and then upwardly along the outside of said carrier mechanism for forming a rotating balloon of yarn during yarn processing, and having selectively-operable pneumatic threading mechanisms for being operated to automatically thread yarn withdrawn from the supply package through said passageway during threading-up of said spindle assembly by creating a suction through the yarn entry portion of said passageway and a positive air stream through the yarn exit portion of said passageway; the combination therewith of a yarn take-up and supply mechanism for cooperation with said threading mechanisms and being characterized by a construction for coiling a given length of yarn from the supply package into a single-layer winding to produce a yarn storage and for releasing the stored yarn to the textile yarn processing machine in a substantially tension-free condition for receipt by said threading mechanisms for threading up of said textile yarn processing machine, said yarn take-up and supply mechanism comprising:

frame means;

selectively-rotatable elongate drum means operatively mounted at one end on said frame and defining an outwardly-extending overhanging free other end for winding of a given length of the yarn on the outside surface thereof;

selectively-operable clamping means mounted on and positioned generally at the free end of said drum means for receiving a free end of the yarn and for clamping and holding the free end of the yarn during winding of the yarn on said drum means and for releasing the free end of the yarn after winding for supplying of the yarn to the textile machine from the surface of said drum by unwinding; and selectively-movable yarn guide means mounted on said frame for slidably receiving the clamped yarn therethrough and for movement from the free end of said drum means rearwardly along said drum means for guiding the yarn onto the outside surface of said drum means for winding thereof into a coiled single layer permitting subsequent unwinding in a substantially tension-free condition and for releasing the yarn and returning to its starting position after winding.

18. In a textile yarn processing machine, as set forth in claim 17, further including a trolley mechanism movably mounted along said textile yarn processing machine and extending along each of said plurality of spindle assemblies and movably carrying said yarn take-up and supply mechanism so that said yarn take-up and supply mechanism may be positioned in front of a respective spindle assembly when a threading-up operation thereof is desired.

19. In a textile yarn processing machine, as set forth in claim 17, in which said mechanism further includes a resilient yarn holding member abutting against the outer surface of said drum means at the rear thereof for engaging and holding at least the last winding of yarn on said drum means during winding so that said yarn guide means may be returned to its starting position without unwinding of the yarn from said drum means and so that the yarn may be easily supplied to said textile yarn processing machine for threading up by unwinding from said drum means from the free end rearwardly to the held winding.

20. In a textile yarn processing machine, as set forth in claim 17, in which said elongate drum means comprises a cone-shaped configuration tapering toward the free end of said drum means for ease in unwinding of the yarn for substantially tension-free supplying of the yarn to the textile yarn processing machine.

21. In a textile yarn processing machine, as set forth in claim 17, in which said yarn take-up and supply mechanism further includes selectively-operable suction means operatively associated with said clamping means for cooperating therewith when said clamping means is open to draw the free end of yarn into said clamping means for subsequent closing of said clamping means to hold the free end of yarn therein.

22. In a textile yarn processing machine, as set forth in claim 17, in which said yarn take-up and supply mechanism further includes selectively-operable compressed air means operatively associated with said clamping means for cooperating therewith when said clamping means is opened for creating a positive compressed air stream to remove the free end of yarn from said clamping means and for conveying the free end of yarn to the entrance of said passageway through said spindle assembly of said textile yarn processing machine for being sucked into said passageway by said threading mechanisms for threading-up of said machine.

23. In a textile yarn processing machine, as set forth in claim 17, in which said textile yarn processing machine further includes an outside frame member extending around at least a portion of said carrier mechanism, and a yarn grip device mounted on said textile yarn processing machine frame member generally at a position near the top of said carrier mechanism and the supply package of yarn carried thereby so that the yarn may be easily withdrawn from the supply package prior to threading-up of said machine and placed in said yarn grip device;

said drum means of said yarn take-up and supply mechanism includes a hollow interior opening outwardly thereof through the free end;

said clamping means of said yarn take-up and supply mechanism comprises a stationary member positioned within the hollow interior of said drum means at the open free end thereof and having an opening therethrough defining an inner outwardly-tapering conical-shaped stationary clamping surface, and a selectively-operable linearly-reciprocating member positioned within the hollow interior of said drum means and having an outer outwardly-tapering conical-shaped movable clamping surface for cooperative movement into and out of clamping engagement with said stationary member;

said yarn take-up and supply mechanism further includes selectively-operable suction means operatively associated with said clamping means and including a source of suction operatively connected with the hollow interior of said drum means for selectively applying suction to said drum means for cooperating with said clamping member when out of clamping engagement for drawing the free end of yarn from said yarn grip device into the hollow interior of said drum means between said clamping members for subsequent closing of said clamping members to hold the free end of yarn therebetween; and said yarn take-up and supply mechanism further including selectively-operable compressed air means including a passageway extending through said movable clamping member and terminating in a nozzle aperture at the forward end thereof and a source of compressed air operatively connected with said passageway through said movable clamping member for creating a positive compressed air stream to remove the free end of yarn from between said clamping members and out of the hollow interior of said drum means when said clamping members are out of clamping engagement with each other and for conveying the free end of yarn to the entrance of said passageway through said spindle assembly for being sucked therein by said threading mechanisms during thread-up of said spindle assembly.

24. In a textile yarn processing machine, as set forth in claim 23, in which said yarn take-up and supply mechanism further includes means mounting said yarn take-up and supply mechanism for selective pivotal movement between a first position in which said clamping means and the free end of said drum means are pointing generally at a location slightly below said yarn grip device for receiving of the free end of the yarn into said clamping means and a second position in which said clamping means and the free end of said drum means are pointing at a location above the entrance to said passageway through said spindle assembly for conveying the free end of yarn by said compressed air means to a location at the entrance to said passageway through said spindle assembly.

25. In a textile yarn processing machine, as set forth in claim 23, in which said yarn take-up and supply mechanism further includes a selectively-rotatable shaft mounted on said frame means and connected at one end to the one end of said drum means for carrying and rotating said drum means and defining a hollow interior therethrough opening into the interior of said drum means and connected at the other end to said source of suction, and a selectively-reciprocatable shaft positioned within the hollow interior of said selectively-rotatable shaft and connected at one end thereof to said movable clamping member for carrying and reciprocating said movable clamping member and defining a hollow interior therethrough opening into said passageway and nozzle aperture in said movable clamping member and being connected at the other end to said compressed air source.

26. In a textile yarn processing machine, as set forth in claim 17, in which said yarn guide means comprises a generally U-shaped cross-sectional configured guide member having a notch extending downwardly from the upper surface thereof at a central location on the connecting leg thereof, and means pivotally mounting said guide member at each of the free ends thereof on said frame means for arcuate movement from a position below the yarn extending outwardly from said clamping means at the free end of said drum means, upwardly while engaging and carrying the yarn, rearwardly along said drum means, and returning to the starting position while releasing the yarn from said notch.

27. In a textile yarn processing machine, as set forth in claim 26, in which said yarn take-up and supply mechanism further includes drive means for being selectively operated to rotate said drum means a predetermined cycle for winding a given length of yarn thereon and comprising selectively-operable motor means and gear means operatively connected to said motor means for being driven thereby and operatively connected to said selectively-rotatable drum mounting shaft for rotating said shaft, and drive means for moving said guide means through a complete cycle of movement from the free end of said drum means, rearwardly along said drum means and back to its starting position during a cycle of driving rotation of said drum means and comprising worm gear means on said drum drive shaft for rotation therewith, worm wheel means in driven engagement with said worm gear means for rotation thereby, rotatable cam means having a camming surface of a predetermined profile thereon and operatively connected to said worm wheel means for rotation thereof one complete revolution during a driving cycle of said drum means, a cam follower positioned in engagement with said camming surface for linear reciprocating movement thereby, rack gear means connected to said cam follower for reciprocating linear movement thereby, and pinion gear means engaging said rack gear means and connected to said yarn guide member for effecting the arcuate movement of said yarn guide member in response to the reciprocating movement of said rack gear member.

28. In a textile yarn processing machine, such as a two-for-one twister or the like, having a plurality of spindle assemblies each including a driven rotating rotor mechanism, a stationary carrier mechanism for carrying a hollow supply package of yarn, and an elongate yarn passageway passing downwardly through the top of said carrier mechanism along the axis of said spindle assembly and radially outwardly through said rotor mechanism for receiving the yarn from the supply package therethrough and then upwardly along the outside of said carrier mechanism for forming a rotating balloon of yarn during yarn processing, and having selectively-operable pneumatic threading mechanisms for being operated to automatically thread yarn withdrawn from the supply package through said passageway during threading-up of said spindle assembly by creating a suction through the yarn entry portion of said passageway and a positive air stream through the yarn exit portion of said passageway; the combination therewith of a yarn take-up and supply mechanism for cooperation with said threading mechanisms and being characterized by a construction for coiling a given length of yarn from the supply package into a single-layer winding to produce a yarn storage and for releasing the stored yarn to the textile yarn processing machine in a substantially tension-free condition for receipt by said threading mechanisms for threading-up of said textile yarn processing machine, said yarn take-up and supply mechanism comprising:

frame means;

selectively-rotatable elongate drum means having one end operatively mounted on said frame, an outwardly-extending overhanging free other end, an outside surface of a cone-shaped configuration tapering toward the free end for winding of a given length of yarn thereon, and a hollow interior opening outwardly through the free end;

selectively-operable clamping means including a stationary member positioned within the hollow interior of said drum means at the open free end thereof and having an opening therethrough defining an inner outwardly-tapering conical-shaped stationary clamping surface, and a selectively-operable linearly-reciprocating member positioned within the hollow interior of said drum means and having an outer outwardly-tapering conical-shaped movable clamping surface for cooperative movement into and out of clamping engagement with said stationary member for receiving a free end of the yarn and for clamping the free end of the yarn during winding of the yarn on said drum means and for releasing the free end of the yarn after winding for supplying of the yarn to the textile machine from the surface of said drum by unwinding;

selectively-operable suction means operatively associated with said clamping means and including a source of suction operatively connected with the hollow interior of said drum means for selectively applying suction thereto for cooperating with said clamping members when out of clamping engagement for drawing the free end of yarn into the hollow interior of said drum means between said clamping members for subsequent closing of said clamping members to hold the free end of yarn therebetween;

selectively-movable yarn guide means of a generally U-shaped cross-sectional configuration having a notch extending downwardly from the upper surface thereof at a central location on the connecting leg thereof and being pivotally mounted at each of the free ends thereof on said frame means for arcuate movement from a position below the yarn extending from said clamping means at the free end of said drum means, upwardly while slidably engaging and carrying the yarn, rearwardly along said drum means for guiding the yarn onto the outside surface of said drum means for winding thereof into a coiled single layer, and returning to the starting position while releasing the yarn from said notch;

a resilient yarn holding member abutting against the outside surface of said drum means at the rear thereof for engaging and holding at least the last winding of yarn on said drum means during winding so that said yarn guide means may be returned to its starting position without unwinding the yarn from said drum means and so that the yarn may be easily supplied to the machine by unwinding from said drum means from the free end rearwardly to the held winding; and selectively-operable compressed air means including a passageway extending through said movable clamping member and terminating in a nozzle aperture at the forward end thereof and a source of compressed air operatively connected with said passageway through said movable clamping member for creating a positive compressed air stream to remove the free end of yarn from between said clamping members and out of the hollow interior of said drum means when said clamping members are out of clamping engagement with each other and for conveying the free end of yarn to the entrance of said passageway through said spindle assembly of said textile yarn processing machine for being drawn into said passageway by said threading mechanisms for threading-up of said machine.

29. In a textile yarn processing machine, as set forth in claim 28, further including a trolley mechanism movably mounted along said textile yarn processing machine and extending along each of said plurality of spindle assemblies and movably carrying said yarn take-up and supply mechanisms so that said yarn take-up and supply mechanism may be positioned in front of a respective spindle assembly when a threading-up operation thereof is desired.

30. In a textile yarn processing machine, as set forth in claim 28, in which said yarn take-up and supply mechanism further includes means mounting said yarn take-up and supply mechanism for selective pivotal movement between a first position in which said clamping means and the free end of said drum means are pointing generally at a location near the top of said carrier mechanism and the supply package of yarn therein for receiving the free end of yarn into said clamping means and a second position in which said clamping means and the free end of said drum are pointing at a location above the entrance to said passageway through said spindle assembly for conveying the free end of yarn by said compressed air means to a location at the entrance to said passageway through said spindle assembly.

31. In a textile yarn processing machine, as set forth in claim 28, in which said take-up and supply mechanism further includes drive means connected with said drum means for being selectively operated to rotate said drum means a predetermined cycle for winding a given length of yarn thereon, and drive means connected with said yarn guide means and with said drum drive means for moving said guide means through a complete cycle of movement from the free end of said drum means, rearwardly along said drum means and back to its starting position during a cycle of driving rotation of said drum means.

32. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn, and an elongate yarn passageway extending downwardly through the top of said carrier mechanism along the axis of said spindle assembly and radially outwardly through said rotor mechanism for receiving the yarn from the supply package therethrough during yarn processing;

selectively-operable pneumatic threading mechanisms for being operated to automatically thread yarn withdrawn from the supply package through said yarn passageway during threading-up of said spindle assemblies by creating a suction through the yarn entry portion of said passageway and a positive air stream through the yarn exit portion of said passageway; and yarn take-up and supply means cooperating with said threading mechanisms for receiving yarn from the supply package carried by said carrier mechanism, for coiling a given length of yarn from the supply package into a single-layer winding to produce a yarn storage and for conveying the stored yarn therefrom to the entry portion of said yarn passageway through said spindle assembly for receipt by the suction created therethrough by said pneumatic threading mechanisms;

whereby, a given length of yarn in a substantially tension-free condition is supplied to said pneumatic threading mechanisms for threading-up of said spindle assembly and is completely removed from said yarn take-up and supply means.

33. A yarn take-up and supply mechanism, as set forth in claim 32, further including a trolley mechanism mounted for movement along the outside of said textile yarn processing machine and along the front of each of said spindle assemblies and carrying said yarn take-up and supply mechanisms so that said yarn take-up and supply mechanism may be conveniently positioned in front of a respective spindle assembly when a yarn take-up and supply operation is desired.

* * * * *